US007673353B1

(12) United States Patent
Khodabandeh

(10) Patent No.: US 7,673,353 B1
(45) Date of Patent: Mar. 9, 2010

(54) SUPER BED

(75) Inventor: Majid Khodabandeh, 11327 Orchard St., Cincinnati, OH (US) 45241

(73) Assignee: Majid Khodabandeh, Cincinnati, OH (US)

( * ) Notice: Subject to any disclaimer, the term of this patent is extended or adjusted under 35 U.S.C. 154(b) by 0 days.

(21) Appl. No.: 11/807,453

(22) Filed: Jul. 31, 2007

(51) Int. Cl.
*A47C 21/04* (2006.01)
*A47C 21/08* (2006.01)
*A47C 29/00* (2006.01)

(52) U.S. Cl. ..... 5/423; 5/284; 5/424; 5/414

(58) Field of Classification Search ..... 5/423, 5/421, 424, 284, 414, 97; 135/96; 128/205.26, 128/205.27, 205.29; 607/81; 4/529
See application file for complete search history.

(56) References Cited

U.S. PATENT DOCUMENTS 157,979 A * 12/1874 Weant ..... 5/97
306,390 A * 10/1884 Fahrney ..... 5/284
406,125 A * 7/1889 Christensen ..... 5/97
771,847 A * 10/1904 Titus et al. ..... 4/529
882,714 A * 3/1908 Proctor ..... 5/284
1,087,806 A 2/1914 Miller
1,347,393 A * 7/1920 McCreary ..... 5/97
1,395,912 A * 11/1921 Ferentzi ..... 126/205
1,594,256 A * 7/1926 Greene ..... 5/97
1,670,658 A * 5/1928 Garbutt ..... 5/421
1,948,048 A * 2/1934 Riley ..... 5/97
1,971,631 A * 8/1934 Whiteley ..... 128/202.13
1,980,516 A * 11/1934 Gail ..... 5/284
1,995,205 A * 3/1935 Gail ..... 5/284
2,012,221 A * 8/1935 Clark et al. ..... 607/83
2,035,343 A * 3/1936 Riley ..... 5/97
2,063,418 A * 12/1936 Whiteley ..... 261/140.1
2,104,024 A * 1/1938 Conboie ..... 454/251
2,104,589 A * 1/1938 Hartman ..... 128/204.15
2,130,703 A * 9/1938 Wylie et al. ..... 5/97
2,149,167 A * 2/1939 Gail ..... 5/284
2,154,638 A * 4/1939 Reeves ..... 454/370
2,188,078 A * 1/1940 Eakin ..... 5/284
2,343,581 A 3/1944 Reeves
2,350,618 A * 6/1944 Johnson ..... 135/16
2,461,432 A * 2/1949 Mitchell ..... 5/284
2,563,399 A * 8/1951 Doane ..... 5/284
2,673,989 A * 4/1954 Veitch ..... 5/97
2,801,428 A * 8/1957 Streeter ..... 5/284
3,505,989 A 4/1970 Truhan
3,583,006 A * 6/1971 Oehms ..... 5/100
3,724,172 A * 4/1973 Wood ..... 95/287
3,763,507 A 10/1973 Propst
3,797,053 A * 3/1974 Mamo ..... 5/97
3,808,607 A * 5/1974 Harder ..... 4/545

(Continued)

*Primary Examiner*—Robert G Santos

(57) ABSTRACT

A bed enclosure comprises a frame having a pair of end frame members. Each of the end frame members includes an arched top portion and straight vertical portions extending downwardly from the arched top portion. The frame includes longitudinal frame members on front and back sides of the frame that are coupled to end frame members wherein the frame includes a bottom frame used to receive a mattress. A pair of roll-up sidewalls each having a handle for rolling up or rolling down the sidewalls to gain access to an interior of the bed enclosure, each sidewall includes plurality of longitudinal rails that is coupled to the frame. The end of each rail is received in respective slots formed in the frame members and each of the sidewall resembles accordion walls which permits a user to enter or exit the bed enclosure.

1 Claim, 6 Drawing Sheets

U.S. PATENT DOCUMENTS 3,848,278 A * 11/1974 Propst ..... 5/603
3,878,570 A * 4/1975 Donnelly ..... 5/97
4,395,785 A * 8/1983 Huh ..... 5/2.1
4,505,078 A * 3/1985 Huh ..... 52/36.2
4,550,457 A * 11/1985 Dukkers ..... 5/414
4,607,401 A * 8/1986 Sisson ..... 5/414
4,641,387 A 2/1987 Bondy
4,937,903 A * 7/1990 Joly et al. ..... 5/414
5,245,998 A * 9/1993 Sundsrud et al. ..... 128/205.26
5,425,753 A * 6/1995 Wege et al. ..... 607/83
5,943,716 A * 8/1999 Chu ..... 5/423
6,119,689 A * 9/2000 Korman ..... 128/205.29
6,487,735 B1 * 12/2002 Jacques et al. ..... 5/424
D493,984 S 8/2004 Hussain
7,150,052 B1 * 12/2006 Lawson et al. ..... 5/97
2005/0011006 A1 * 1/2005 Ellen et al. ..... 5/424

* cited by examiner

SUPER BED

FIELD OF THE INVENTION

The present invention relates to an enclosure structure for beds and more particularly to an enclosure structure having an air conditioning attached thereto.

BACKGROUND OF THE INVENTION

Numerous bed enclosures have been provided in prior art. Many of these bed enclosures are used in health care facilities for patients suffer from mental or physical conditions which require that they be restricted to their beds for their own and others' safety. One disadvantage of these bed enclosures is that body restraints are often employed to achieve the desired immobilization objective. Another disadvantage of these bed enclosures includes physical discomfort, physiological discomfort, and an inability to employ such restraint due to the type of infirmity experienced by the patient. Attempts have been made by the prior art to overcome certain of the aforementioned disadvantages by developing enclosure-type structures for hospital beds. For example, U.S. Pat. Nos. 1,087,806 to Miller; 2,343,581 to Reeves; 3,505,989 to Truhan and 3,763,507 to Propst all are illustrative of such prior art. While these patents may be suitable for the particular purpose to which they address, they would not be as suitable for the purposes of the present invention as heretofore described.

SUMMARY OF THE INVENTION

A primary object of the present invention is to provide a bed enclosure for a user that will overcome the shortcomings of the prior art devices.

Another object of the present invention is to provide desirable psychrometric conditions in the bed enclosure and particularly by providing gradual changes in the conditioned of the air quality based a desired psychrometric condition which substantially reduces the cost of heating or cooling of a residential bed room.

A further object is to provide a bed enclosure that is designed to protect a person sleeping in the bed enclosure from falling from the bed.

According to yet another object is to provide a bed enclosure for a person that is simple and easy to use and is economical in cost to manufacture.

To accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

A full understanding of the invention can be gained from the following description of the preferred embodiments when read in conjunction with the accompanying drawings in which.

DETAIL DESCRIPTION OF THE PREFERRED EMBODIMENTS

Figure 1:
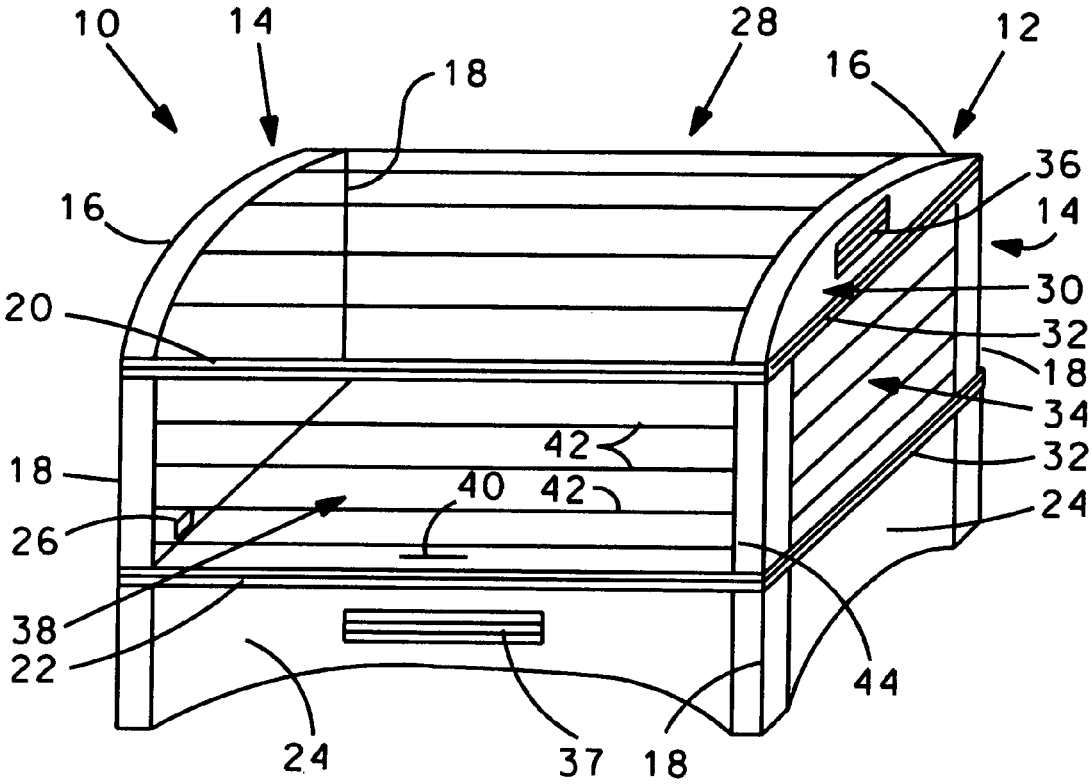
FIG. 1 is a perspective view of a bed enclosure having an air conditioning device attached thereto in accordance to a preferred embodiment of the present invention.
Figure 1A:
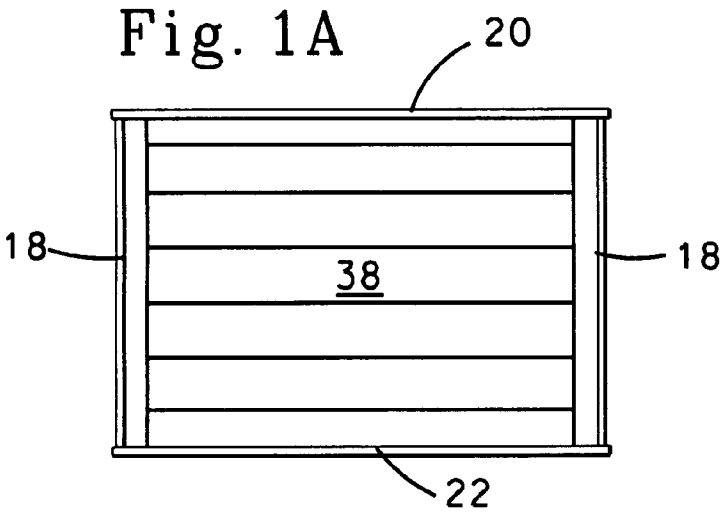
FIG. 1A is a back side elevation view of the bed enclosure shown in FIG. 1.
Figure 1B:
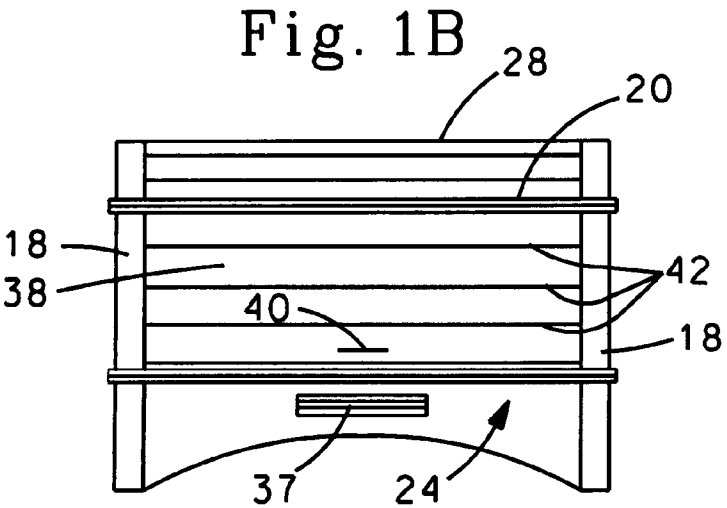
FIG. 1B is a front side elevation view of the bed enclosure having a first vent panel shown in FIG. 1.
Figure 1C:
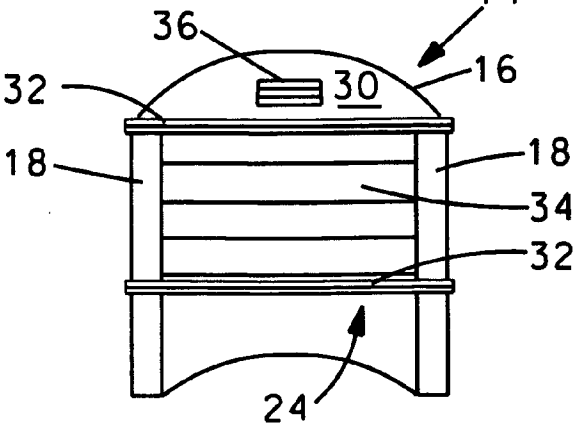
FIG. 1C is a front end side elevation view of the bed enclosure having a second vent panel shown in FIG. 1.
Figure 2:
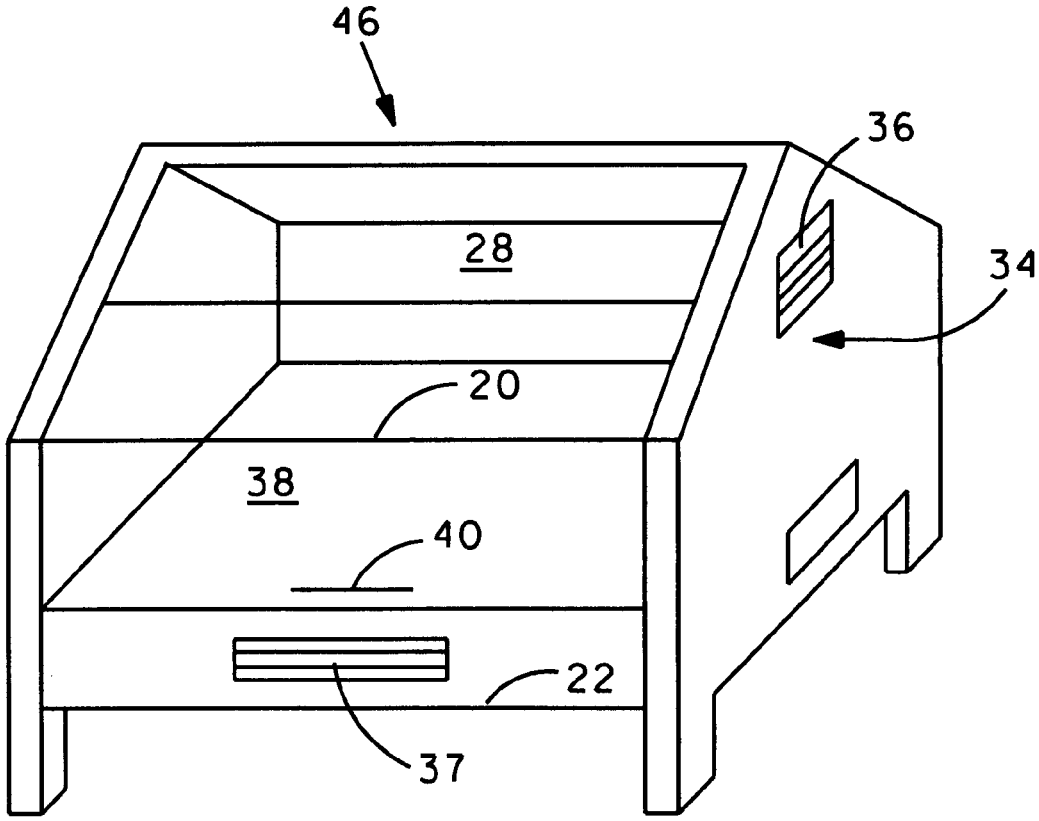
FIGS. 2-5 are a perspective view of a bed enclosure having an air conditioning device attached thereto in accordance to various embodiments of the present invention.
Figure 3:
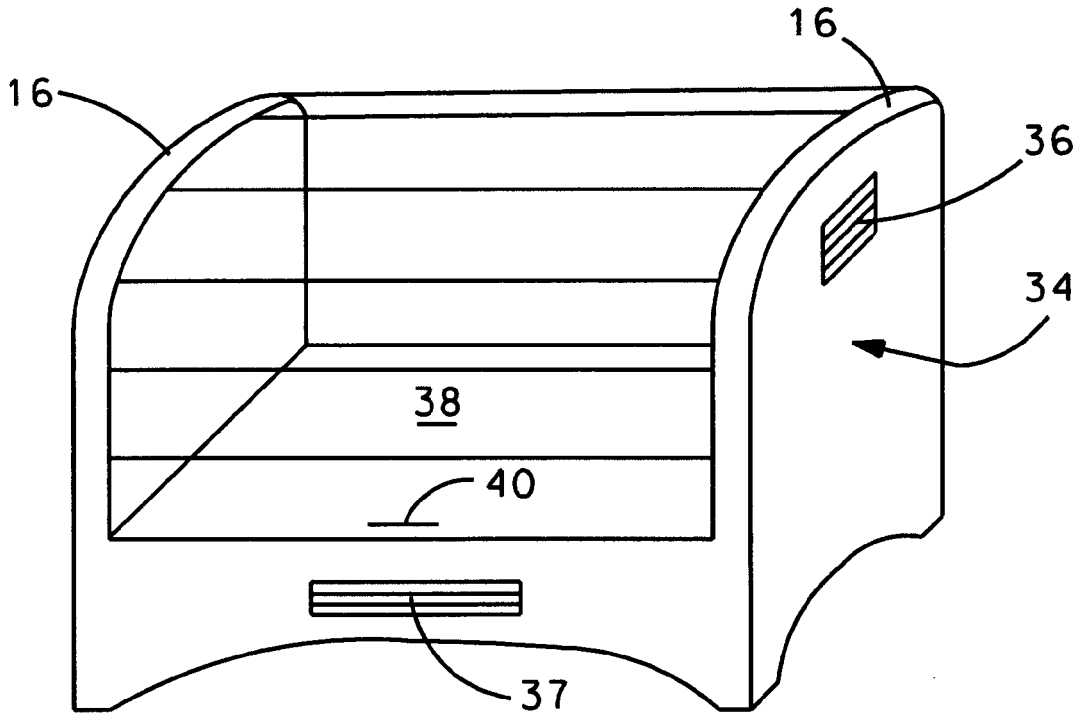
Figure 4:
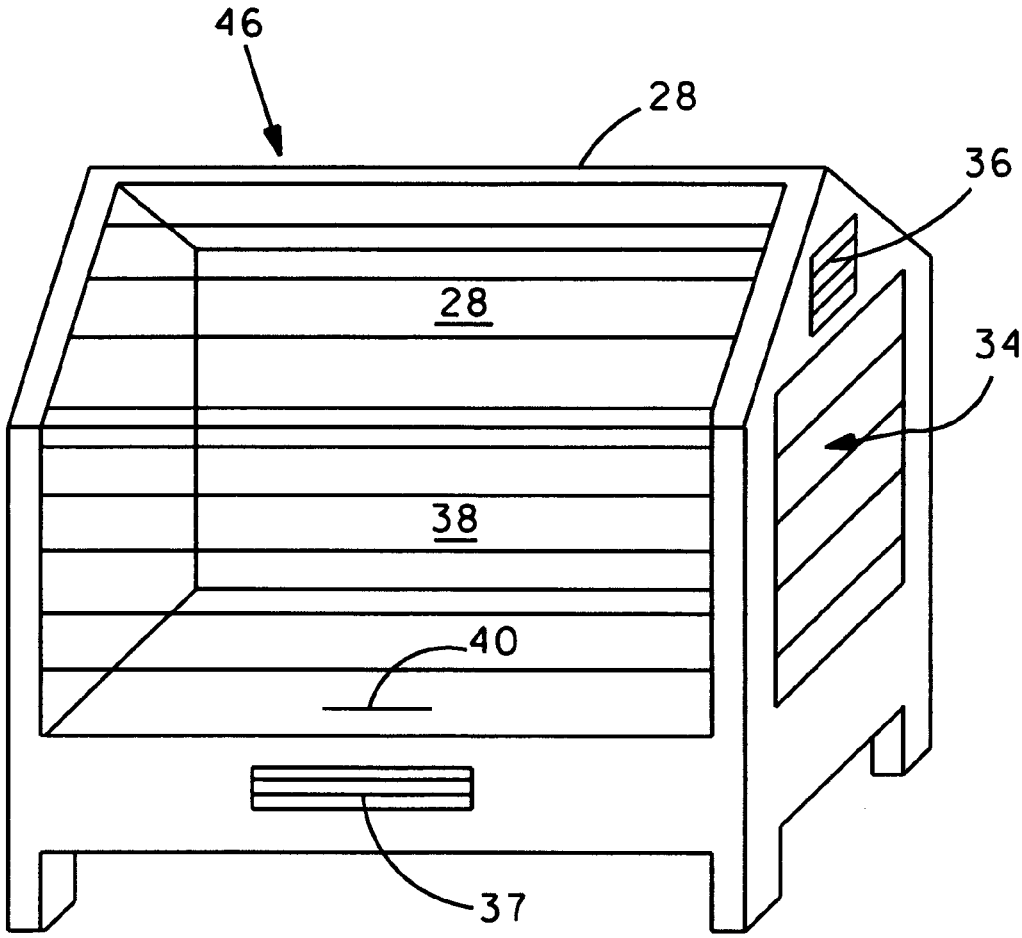
Figure 5:
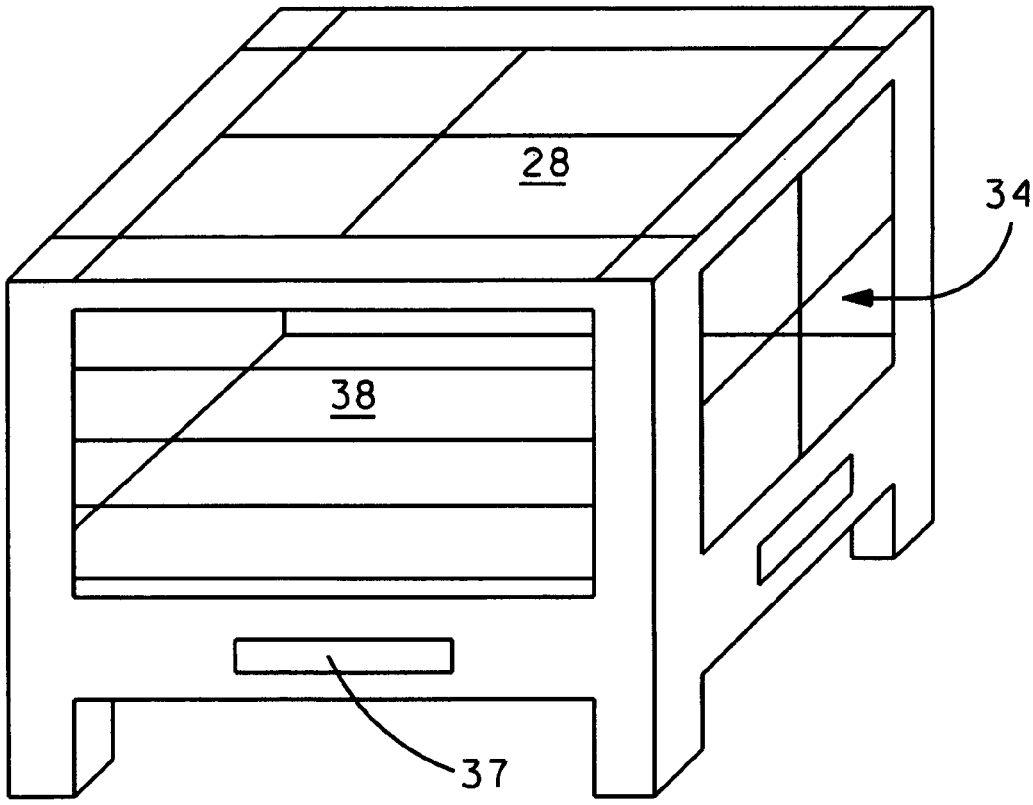

A preferred bed enclosure in accordance with the invention is indicated generally at 10 in the drawings. FIG. 1 is a perspective view of a bed enclosure 10 having an air conditioning device (not shown) attached thereto in accordance to a preferred embodiment of the present invention. A bed enclosure 10 includes a frame 12 having a pair of end frame members 14, each of which has an arched top portion 16 and straight vertical portions 18 extending downwardly from the respective arched top portion 16. Frame 12 also includes longitudinal frame members 20 and 22 on front and back sides of the frame 12 that are coupled to end frame members 14. Suitable components (not shown), such as, for example, posts, pins, clamps, hooks, or latches, are provided for coupling frame 12 to a base frame 24 of the bed to raise and lower therewith. Bed enclosure 10 also includes a thermostat 26 that is substantially similar in function to an air conditioning thermostat used in residential homes.

Bed enclosure 10 includes an arched top wall 28 coupled to and extending between arched top portions 16 of frame members 14. Top wall 28 preferably is made from a clear plastic sheet of material. Bed enclosure 10 further includes a pair of upper end wall portions 30 coupled to and extending vertically between respective transverse frame members 32 and the associated arched top portions 16. End wall portions 30 are also preferably made from a clear plastic sheet of material. Bed enclosure 10 includes a pair of lower end wall portions 34 extending between the respective straight vertical portions 18 of frame members 14 and extending between respective transverse frame members 32. The end wall portion 30 and the bottom frame 24, each includes a respective first vent panel 36 and second vent panel 37 used to dispel the air from the inside of the bed enclosure 10 to the surroundings. The bottom frame 24 also include a mattress (not shown) to permit a user to sleep thereon.

Bed enclosure 10 includes a pair of "roll-up" sidewalls 38 each having a handle 40 for rolling up or rolling down the sidewalls 38 to gain access to the interior of the bed enclosure 10. Each sidewall 38 also includes a plurality of longitudinal rails 42 coupled to the frame 14. The ends of each rail 42 are received in respective slots 44 formed in the frame members 14. Each of the sidewall 38 resembles accordion walls which permits a user to enter or exit the bed enclosure 10. In operation, a user rolls-up the sidewall 38 to enter the enclosure bed 10 and roll-down the sidewall 38 to enclose the enclosure bed while the user sleeps therein. Depending on the design, the bed enclosure 10 is generally rectangular in shape; however, other geometrical shapes may be used accordingly. The frame of bed enclosure 10 is formed from wood, metal or plastic as well known in the art. It is well within the scope of this invention to use any suitable material well known or later developed in the art.

FIGS. 2-5 are a perspective view of the bed enclosure 10 having an air conditioning device attached thereto in accordance to various embodiments of the present invention. The bed enclosure in FIGS. 2-5 are the same as the bed enclosure 10 described hereinabove with respect to FIG. 1, except that these figures illustrate different configuration. For example, the bed enclosures in FIGS. 2 and 4 include a gable top wall 46.

Manual set-up of the enclosure bed 10 is easily accomplished. First the base frame 24 is configured so that a mattress can be placed therein. Next, the end frame members 14 are attached to the base frame 24 and the longitudinal frame members 20 and 22 on front and back sides of the frame 12 that are coupled to end frame members 14. Finally, the arched top portion 16 and straight vertical portions 18 extending downwardly from the respective arched top portion 16 are attached to one another. The thermostat 26 is installed inside the enclosure bed 10 and the air conditioning system (not shown) is installed optionally underneath of the enclosure bed 10.

While the invention has been described with reference to a preferred embodiment, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A bed enclosure comprising:

a frame having a pair of end frame members, each of the end frame members includes an arched top portion and straight vertical portions extending downwardly from the arched top portion and having a first vent panel, the frame includes longitudinal frame members on front and back sides of the frame that are coupled to the end frame members wherein the frame includes a bottom frame having a second vent panel, the frame used to receive a mattress and wherein the bed enclosure includes an arched top wall coupled to and extending between arched top portions of the end frame members;

a pair of roll-up sidewalls each having a handle for rolling up or rolling down the sidewalls to gain access to an interior of the bed enclosure, each sidewall includes a plurality of longitudinal rails coupled to the frame, the ends of each rail being received in respective slots formed in the end frame members and each of the sidewalls resembles accordion walls which permits a user to enter or exit the bed enclosure;

a pair of upper end wall portions coupled to and extending vertically between respective transverse frame members and the associated arched top portions wherein the first vent panel is formed in the upper end wall portions to dispel air from inside of the bed enclosure to the surroundings;

a pair of lower end wall portions extending between the respective straight vertical portions of the end frame members and extending between respective transverse frame members; and an air conditioning device having a thermostat attached to the bed enclosure to control the temperature of the air.

* * * * *